US009273674B2

(12) United States Patent
Schmidt et al.

(10) Patent No.: US 9,273,674 B2
(45) Date of Patent: Mar. 1, 2016

(54) DEVICE AND METHOD FOR THE DEFINED LONGITUDINAL SHIFTING OF AN ADJUSTING DEVICE, WHICH ROTATES ALONG IN A DRIVE SHAFT

(75) Inventors: Andreas Schmidt, Schwarzbach (DE); Franz Pawellek, Lautertal (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 385 days.

(21) Appl. No.: 14/002,255

(22) PCT Filed: Feb. 22, 2012

(86) PCT No.: PCT/DE2012/000172

§ 371 (c)(1), (2), (4) Date: Aug. 29, 2013

(87) PCT Pub. No.: WO2012/116675

PCT Pub. Date: Sep. 7, 2012

(65) Prior Publication Data

US 2013/0336822 A1 Dec. 19, 2013

(30) Foreign Application Priority Data

Mar. 2, 2011 (DE) ..... 10 2011 012 827

(51) Int. Cl.

*F04B 9/06* (2006.01)
*F04D 29/46* (2006.01)
*F04D 15/00* (2006.01)

(52) U.S. Cl.

CPC ..... *F04B 9/06* (2013.01); *F04D 15/0038* (2013.01); *F04D 29/466* (2013.01)

(58) Field of Classification Search

CPC ..... F04B 9/06; F04B 2211/7052; F04D 15/0038; F04D 15/0055; F04D 15/466; F04D 15/468

USPC ..... 60/477; 417/437

See application file for complete search history.

(56) References Cited

U.S. PATENT DOCUMENTS 4,798,517 A 1/1989 Katsumoto et al.
4,828,455 A 5/1989 Kinbara et al.
6,796,766 B2 9/2004 Hesse (Continued)

FOREIGN PATENT DOCUMENTS

DE 21 10 776 A1 9/1972
DE 37 32 038 C2 12/1992

(Continued)

OTHER PUBLICATIONS

International Search Report of PCT/DE2012/000172, mailed Nov. 21, 2012, two pages.

*Primary Examiner* — Dwayne J White
*Assistant Examiner* — Logan Kraft
(74) *Attorney, Agent, or Firm* — Collard & Roe, P.C.

(57) ABSTRACT

The invention relates to a device and method for the defined longitudinal shifting of an adjusting device which rotates along in a drive shaft, along the center axis of the drive shaft. The solution according to the invention is characterized in that a working chamber (12) is arranged at the opposite end of the drive shaft (1), into which working chamber a passage hole (7) arranged in the drive shaft (1) opens, wherein a working piston (13) that operatively connects to the working chamber (12) is arranged in such a way that, in the event of a pressure build-up in the working chamber (12), the adjusting device (2) is variably moved against the spring force of a restoring spring (10) by means of a radial piston pump according to the invention that is arranged on the drive shaft (1).

5 Claims, 2 Drawing Sheets

(56) References Cited

U.S. PATENT DOCUMENTS

Figure 1:
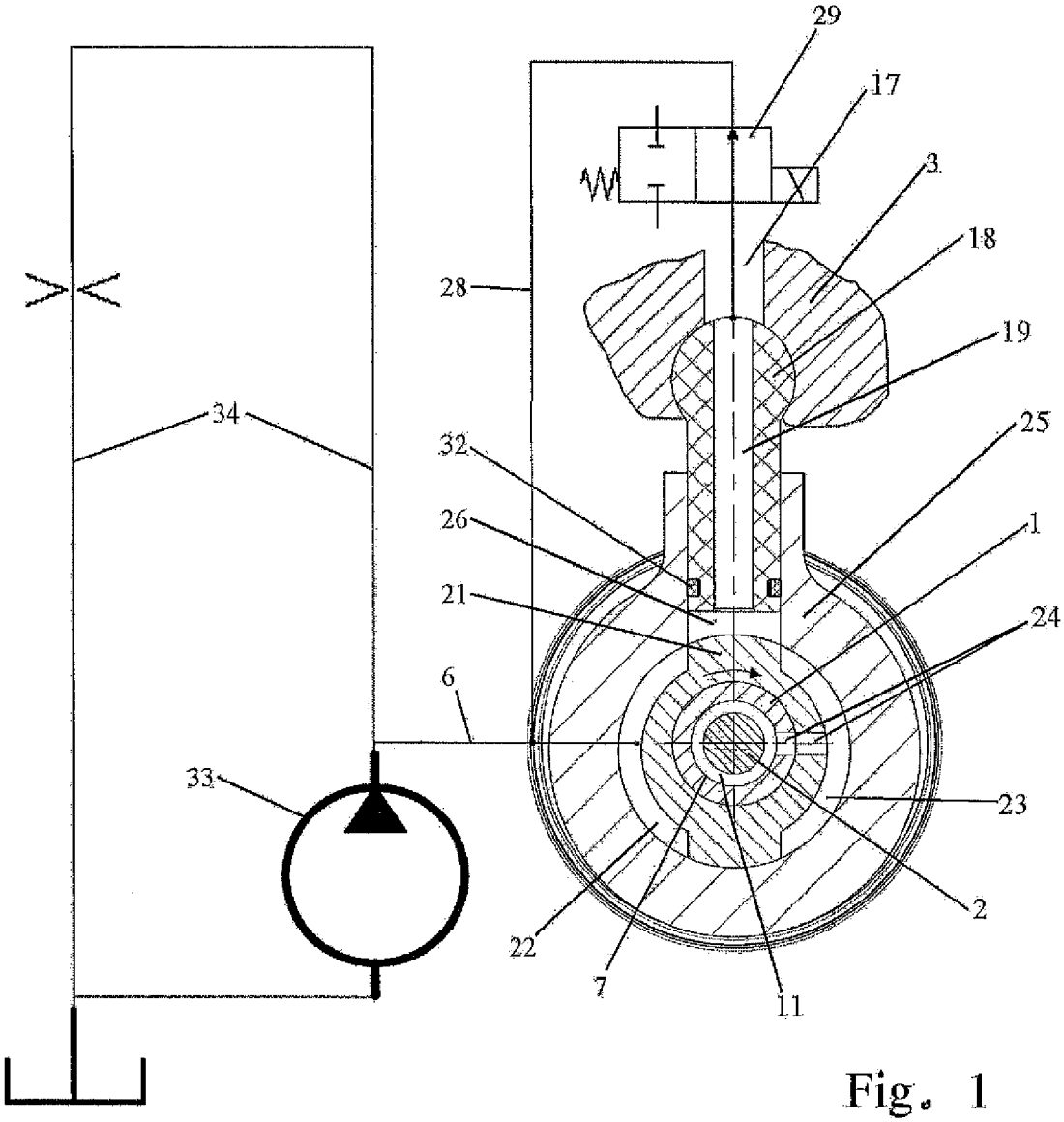

| | | | | |
|---|---|---|---|---|
| 8,297,942 | B2 | 10/2012 | Schmidt et al. | |
| 2011/0162597 | A1 | 7/2011 | Draheim et al. | |
| 2011/0188987 | A1 | 8/2011 | Schmidt et al. | |
| 2012/0111291 | A1 * | 5/2012 | Popp | F01P 7/162 123/41.09 |

FOREIGN PATENT DOCUMENTS

| | | | |
|---|---|---|---|
| DE | 199 01 123 | A1 | 7/2000 |
| DE | 10 2008 022 354 | A1 | 11/2009 |
| DE | 10 2008 026 218 | A1 | 12/2009 |
| DE | 10 2008 046 424 | A1 | 3/2010 |

* cited by examiner

DEVICE AND METHOD FOR THE DEFINED LONGITUDINAL SHIFTING OF AN ADJUSTING DEVICE, WHICH ROTATES ALONG IN A DRIVE SHAFT

CROSS REFERENCE TO RELATED APPLICATIONS

This application is the National Stage of PCT/DE2012/000172 filed on Feb. 22, 2012, which claims priority under 35 U.S.C. §119 of German Application No. 10 2011 012 827.1 filed on Mar. 2, 2011, the disclosures of which are incorporated by reference. The international application under PCT article 21(2) was not published in English.

The invention relates to an apparatus and a method for defined longitudinal displacement of an adjustment apparatus that rotates along with and within a drive shaft, along the center axis of the work shaft.

In the state of the art, apparatuses for defined longitudinal displacement of adjustment apparatuses that rotate along with and within the drive shaft, i.e. along the center axis of the drive shaft, are previously described in connection with the regulation of liquid or gaseous volume streams in pumps or compressors.

For example, DE 2110776 A1 describes a flow work machine having regulatable impeller cross-sections, in which machine an adjustment spindle that rotates along, driven by way of the blade wheel, is disposed within the drive shaft, which spindle can be longitudinally displaced in the drive shaft by means of a piston drive provided with a regulator.

This solution has the disadvantages that it requires a very large construction space, is material-intensive and cost-intensive, furthermore has a structure that is very susceptible to failure, does not switch to maximal power automatically if the regulation fails, and furthermore carries a high risk with regard to the aspect of work safety.

In other designs, the adjustment apparatus and the work spindle are disposed not within one another in the axial direction, as described above, but rather disposed to lie flush with and opposite one another.

Such a design is previously described in DE 37 32 038 C2. In this design, the adjustment apparatus is once again carried along by the drive shaft, by way of the blade wheel. In this solution, the adjustment apparatus can be displaced in defined manner, by means of a partial vacuum, by way of a separate activation element disposed on the pump housing, lying opposite to the drive means of the drive shaft, a V-belt pulley.

Failure of the regulation brings about the result that in this solution, a switch to maximal pump power takes place automatically, by means of a reset spring.

However, this design also requires a very large construction space in connection with the pressurized lines, the required pressure regulator, etc., and is therefore also material-intensive and cost-intensive.

In other solutions, adjustment apparatuses in the form of pressure-spring-impacted thermostats/wax elements were integrated on the drive shaft, with significantly less effort and a smaller construction volume.

Such solutions are previously described, for example, in U.S. Pat. No. 4,828,455 or also in DE 199 01 123 A1.

The significant disadvantage of these solutions, however, consists in that they react too slowly for active regulation of the conveyed coolant amount, and by no means are able to influence the engine temperature in such a way, after it has warmed up (i.e. in "continuous operation"), that not only the pollutant emissions but also the friction losses and also the fuel consumption could be clearly reduced in the entire work range of the engine.

For this reason, it was proposed, for example in DE 10 2008 046 424 A1, to use electromagnetically activated adjustment apparatuses, i.e. to displace rotating components using a magnetic coil disposed in the pump housing.

In this solution, a magnet armature is rigidly disposed in the magnetic field of a magnetic coil integrated into the pump housing, at the end of the adjustment apparatus that lies opposite the adjustment element, by means of which the adjustment apparatus guided in the drive shaft can be linearly displaced, under the effect of the electromagnetic field of the magnetic coil.

The installation of such electromagnetically activated adjustment elements, for example in the vicinity of the turbocharger, necessarily requires cooling of the magnetic coil (and thereby a relatively large "construction space"), because the magnetic coil would be destroyed at temperatures starting from 120° C.

This relatively large "construction space" that is in turn necessarily required, also for the magnetic coil disposed in a pump housing, according to DE 10 2008 046 424 A1, is diametrically opposed to the very limited "installation space" that is available in the engine compartment.

Furthermore, a disadvantage of this solution is that production and installation are very cost-intensive, because the functional modules cannot be uniformly produced for multiple construction sizes, i.e. standardized, and therefore have to be produced separately for every pump housing size.

The invention is therefore based on the task of developing an apparatus and a method for defined longitudinal displacement of an adjustment apparatus that rotates along with and within a drive shaft, along the shaft center axis of the drive shaft, particularly in connection with the regulation of liquid or gaseous volume streams in pumps or compressors, which eliminates the aforementioned disadvantages of the state of the art, and, in this connection, guarantees active and reliable regulation of the longitudinal displacement over the entire range of the speed of rotation and temperature, with very little work effort, which is furthermore suitable even for high-rpm applications and can be used even under disadvantageous general thermal conditions, such as in the vicinity of a turbocharger, for example, while having a small and compact structure, working robustly, and optimally utilizing the existing construction space, furthermore can be produced, at the same time, in simple and cost-advantageous manner, in terms of production and assembly technology, always guarantees a high level of operational safety and reliability, and is suitable as a unit even for different pump sizes, i.e. can be produced in "standardized" manner, and, at the same time, can be integrated into any desired regulation circuits, in simple and cost-advantageous manner.

According to the invention, this task is accomplished by means of an apparatus and a method for defined longitudinal displacement of an adjustment apparatus that rotates along with and within a drive shaft, along the center axis of the work shaft, in accordance with the characteristics of the independent claims of the invention.

Figure 2:
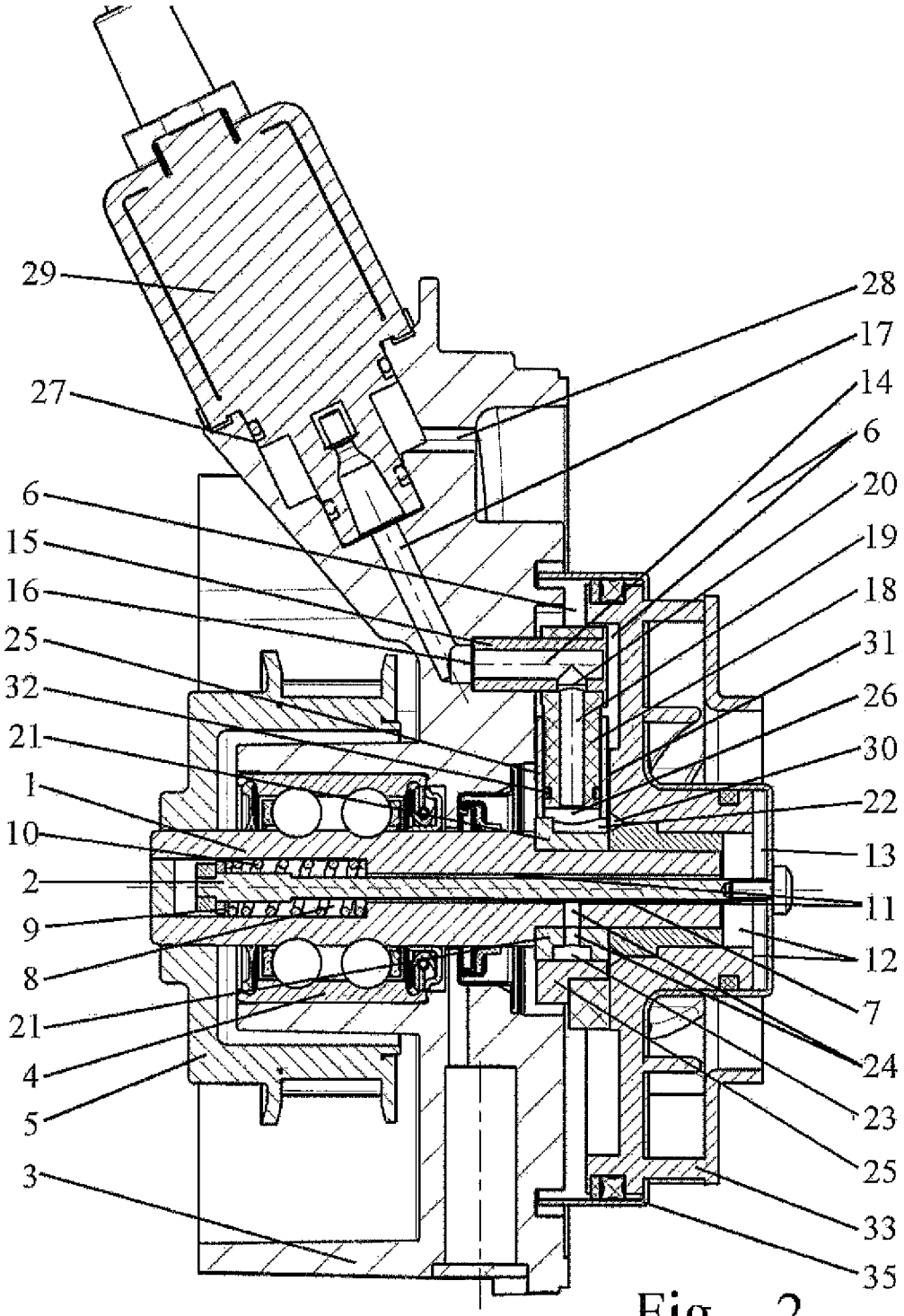

In this connection, the figures show:

FIG. 1: a schematic representation of the principle of action of the invention for defined longitudinal displacement of an adjustment apparatus that rotates along with and within a drive shaft;

FIG. 2: a possible design embodiment of the solution according to the invention, for defined longitudinal displacement of an adjustment apparatus that rotates along with and within a drive shaft, in section, in a side view.

This solution according to the invention, for defined longitudinal displacement of an adjustment apparatus 2 that rotates along with and within a drive shaft 1, along the center axis of the work shaft, shown in FIG. 1 in the form of a schematic representation of the principle of action of the invention, in an axial section, and in FIG. 2 in the form of one of the possible design embodiments of the solution according to the invention, in section, in a side view, having a drive shaft 1 mounted in/on a housing 3, in a bearing 4, driven by a drive element 5, projecting into a work space 6 filled with pressurized medium, having a through-hole 7 that accommodates the adjustment apparatus 2, is characterized in that a spring chamber 8 is disposed on the drive-side end, in the through-hole 7, and that a spring stop 9 is disposed on the drive-side end of the adjustment apparatus 2, in such a manner that the adjustment apparatus 2 is always brought back into a defined starting position after every axial displacement, by means of a reset spring 10 that is disposed in the spring chamber 8. It is essential to the invention, in this regard, that a work chamber 12 is disposed at the end of the drive shaft 1 that lies opposite the drive element 5, into which chamber the through-hole 7 opens, whereby a ring space 11 is disposed between the through-hole 7 and the adjustment apparatus 2 disposed in this bore, whereby a work piston 13 that enters into an active connection with the work chamber 12 is disposed at the end of the adjustment apparatus 2 that lies opposite the spring stop 9, in such a manner that when pressure builds up in the work chamber 12, the adjustment apparatus 2 can be variably displaced in the through-hole 7, counter to the spring force of the reset spring 10.

It is characteristic, in this connection, that a pump piston 18 having a piston pass-through bore 19, which bore opens into a pressure channel 17 disposed in the housing 3, is disposed in the housing 3, so as to pivot.

A significant characteristic of the invention, in this connection, consists in that an eccentric bushing 21 is disposed in the region of the pump piston 18, on the drive shaft 1, so as to rotate with it, in which bushing a suction kidney 22 connected with the work space 6, on the one hand, and a pressure kidney 23 that lies opposite on the circumference of the eccentric bushing 21, on the other hand, are disposed, whereby the pressure kidney 23 has a transfer bore 24 disposed in the eccentric bushing 21, which bore opens into a further transfer bore 24 disposed adjacent to the drive shaft 1, and thereby connects the pressure kidney 23 directly with the ring space 11.

It is also essential to the invention, in this connection, that a cylinder ring 25 having a piston bore 26 for the pump piston 18 is disposed on the outer mantle of the eccentric bushing 21, so as to rotate, in such a manner that when the eccentric bushing 21 is rotating, the pump piston 18 "works" in the piston bore 26 of the cylinder ring 25, i.e. moves vertically up and down in oscillating manner, and pumps medium contained in the work space 6 into the pressure kidney 23, by way of the suction kidney 22, when the solenoid valve 29 is closed, which medium is conveyed from there into the work chamber 12, by way of the transfer bores 24 and the ring space 11.

In this connection, it is characteristic that a valve seat 27 is disposed in the housing 3, into which seat the pressure channel 17 opens, on the one hand, and a return line 28 connected with the work space 6 opens, on the other hand, whereby a solenoid valve 29 is disposed in the valve seat 27, between the pressure channel 17 and the return line 28.

When the drive shaft 1 is rotating and the solenoid valve 29 is closed, the pump piston 18, which moves vertically up and down in the piston bore 26 of the cylinder ring 25, in oscillating manner, according to the invention, causes medium contained in the work space 6 to be pumped into the pressure kidney 23, by way of the suction kidney 22, and from there to be conveyed into the work chamber 12 by way of the transfer bores 24 and the ring space 11.

It is also advantageous, in this connection, that piston rings 32 are disposed on the outside circumference of the region of the pump piston 18 that is displaceably mounted in the piston bore 26 of the cylinder ring 25, which rings guarantee a high degree of effectiveness of the arrangement according to the invention, with little production and assembly effort.

In FIG. 2, one of the possible design embodiments of the solution according to the invention is now shown, in the design of a coolant pump for motor vehicles, having a setting slide 35 that can be displaced by way of the adjustment apparatus 2, which slide serves for varying the "effective" blade width of the vane wheel.

The drive shaft 1, which is mounted in the housing 3 in a bearing 4, driven by a drive element 5, projecting into a work space 6 filled with pressurized medium, in which shaft a through-hole 7 that accommodates the adjustment apparatus 2 is disposed, is particularly characterized in that a pivot cylinder 15 provided with a dead-end bore 14 that is closed off toward the work space 6 is disposed in the housing 3 on the work space side, the open bore end 16 of which cylinder opens into a pressure channel 17, whereby a pump piston 18 having a piston pass-through bore 19 is disposed on the pivot cylinder 15, so as to rotate, and this piston pass-through bore 19 opens into the dead-end bore 14 of the pivot cylinder 15 by way of a through-passage bore 20 disposed in the pivot cylinder 15 in the region of the piston pass-through bore 19.

It is also characteristic, in this connection, that the transfer region into the suction kidney 22 that is open at a side wall is configured as a ring channel 30, adjacent to which, on the outside, i.e. toward the work space 6, a ring-shaped gap filter 31 is disposed, so that in this region, passage of cooling medium from the pump interior 14 into the ring channel 30 is possible, whereby penetration of undesirable particle sizes of chips and sand grains is prevented by means of the setting of the filter gap of the ring-shaped gap filter 31.

If now, in this concrete embodiment according to the invention, as shown in FIG. 2, the drive shaft 1 is put into rotational movement by way of the drive element 5, a belt pulley, then at the same time, the eccentric bushing 21 disposed on the drive shaft 1 so as to rotate with it, which bushing is provided with a suction kidney 22 that is open toward the side wall on the vane wheel side, on the one hand, and with a pressure kidney 23 that is open toward the passage bore 7 in the drive shaft 1, on the other hand, is put into rotational movement.

In this connection, the cylinder ring 25 that is mounted on the outer mantle of this eccentric bushing 21, so as to rotate, is put into lifting movements with the piston bore 26 disposed in it.

The work piston 13 disposed in the piston bore 26, with its piston pass-through bore 19 disposed in the work piston 13, easily oscillates around the pivot cylinder 15 provided with the dead-end bore 14, when the eccentric bushing 21 is rotating; the piston pass-through bore 19 opens into the dead-end bore 14 by way of a through-passage bore 20 disposed in the pivot cylinder 15.

The vane wheel bushing of the vane wheel of the conveying pump 33, shown in FIG. 2, disposed on the drive shaft 1, by means of being disposed in the vane wheel as an insert, lies against the eccentric bushing 21 in the embodiment shown in this FIG. 2, whereby the vane wheel forms a gap filter 31 with the adjacent face side of the cylinder ring 25, adjacent to which the ring channel 30 is disposed on the eccentric bushing side.

The (open side wall of the) suction kidney 22 is disposed laterally adjacent to this ring channel 30.

As a result, continuous passage of medium, by way of the ring-shaped gap filter 31, from the work space 6 into the ring channel 30, and, by way of the latter, into the suction kidney 22, which is open on the side wall side in the region of the ring channel 30, is guaranteed.

As is shown in FIGS. 1 and 2, a conveying pressure is built up in connection with the conveying pump 33, in the work space 6, and, for example, at the same time, also in a conveying circuit 34.

The rotating drive shaft 1 according to the invention now also brings about defined "conveying" of the medium, according to the invention, from the work space 6, by way of the suction kidney 22, into the piston bore 26, and from there, by way of the piston pass-through bore 19, and in an embodiment as shown in FIG. 2, further by way of a through-passage bore 20 and a dead-end bore 14 of a pivot cylinder 15, into the pressure channel 17 regulated by the solenoid valve 19.

When the solenoid valve 29 is open, the medium conveyed in this manner flows back into the work space, by way of the solenoid valve 29 and a return line 28, and the setting slide 35 shown in FIG. 2 lies against the vane wheel of the conveying pump 33 in its rearmost end location position.

In this connection, the gap dimensions between the housing 3 and the setting slide 35 are dimensioned in such a manner that an inflow of conveying medium from the work space 6 into the ring channel 30 is guaranteed even in the rearmost end position.

When the solenoid valve 29 is closed, a "dynamic pressure" is built up from the piston bore 26 all the way to the pressure channel 17, which brings about the result that medium pumped into the piston bore 26 by the suction kidney 22 is pressed into the pressure kidney 23, and from there gets into the ring space 11 by way of the transfer bores 24, enters into the work chamber 12 by way of this space, and there brings about a displacement of the work piston 13, counter to the spring force of the reset spring 10, and, in this connection, as shown in FIG. 2, activates a setting slide 35, for example.

The stroke of the pump piston 18 in the piston bore 26 of the cylinder ring 25 amounts to approximately 1 mm to 2 mm per revolution in the present exemplary embodiment. As a result of the arrangement according to the invention, even very small conveying amounts are already sufficient for precise displacement of the work piston 13, which is rigidly disposed on the spring-loaded adjustment apparatus 2.

The method according to the invention for defined longitudinal displacement of an adjustment apparatus 2 that rotates along with and within a drive shaft 1, by means of the apparatus described above, is characterized, in this connection, in that the adjustment apparatus 2 can be displaced in the longitudinal direction in defined manner, by means of a solenoid valve 29 by varying the pressure in the pressure channel 17.

When the solenoid valve 29 is "open," i.e. without current in the present exemplary embodiment, the piston pump according to the invention conveys medium, here coolant, back into the work space 6 by way of the return line 28 of the solenoid valve 29, in "pressure-free" manner, as has already been explained.

If now the return flow of the medium conveyed by the piston pump according to the invention into the return line 28 and thereby back into the work space 6 is throttled or actually completely prevented by means of the solenoid valve 29, then the cooling medium conveyed by the arrangement according to the invention is pressed into the work chamber 12 by way of the ring space 11, and thereby the pressure in the ring space 11 and also in the work chamber 12 is first increased, in step-free manner.

In this connection, the medium pressed into the work chamber 12 in this manner brings about a defined pressure application to the work piston 13 shown in FIG. 2 of the adjustment apparatus 2 spring-loaded by the reset spring 10, which pressure can be adjusted (by way of the solenoid valve 29), and thereby a defined longitudinal displacement of the adjustment apparatus 2 that rotates along with and within the drive shaft 1.

This defined application of pressure to the cross-sectional surface area of the work piston 13 by way of the solenoid valve 29 now makes precise translational displacement of an adjustment apparatus 2 that rotates along with and within the drive shaft 1 possible, as shown in the exemplary embodiment according to FIG. 2, for example, and thereby the adjustment of a displaceable setting slide 35 that is disposed on this rotating adjustment apparatus 2 and rotates with it, for variation of the "effective" blade width of a vane wheel of a conveying pump 33.

In this connection, the arrangement according to the invention guarantees active and reliable regulation of the longitudinal displacement of the adjustment device 2 over the entire range of speed of rotation and temperature, in all the embodiments presented, at very low drive power.

Because of the forced operation by means of the eccentric drive, according to the invention, of the pump according to the invention, the present solution is suitable even for applications at high speeds of rotation.

The solution according to the invention has a very small construction and optimally utilizes the available construction space, is very compact and works very robustly and reliably.

In this connection, the present solution can be produced in simple and cost-advantageous manner, in terms of production and assembly technology, and always guarantees great operational reliability.

Even under very disadvantageous thermal general conditions, such as, for example, in the vicinity of a turbocharger in a motor vehicle, and, at the same time, with greatly limited installation space, the solution according to the invention guarantees optimal cooling with minimized construction volume and great reliability, as a result of the provision of a solenoid valve 29 that is simultaneously cooled by the conveying medium.

Even in the event of failure of the regulation mechanism, "fail-safe" operation can be implemented as described below, by means of the solution according to the invention.

In the non-powered state, the solenoid valve 29 opens, the pressure in the pressure channel 17 and in the work chamber 12 drops, and spring-loaded "movement back" to the rearmost work position of the regulating slide 35 takes place, in the embodiment of the invention as shown in FIG. 2, for example into "emergency operation," i.e. a "fail-safe" position.

When the adjustment apparatus 2 "moves back," the medium contained in the work chamber 12, and also the medium being pumped by the arrangement according to the invention at this time, is passed into the return line 28 by way of the pressure channel 17 and the solenoid valve 29 (which is open when the adjustment apparatus 2 moves back), and from there back into the work space 6.

When the adjustment apparatus 2 is "held" in an intermediate position, the flow through the solenoid valve 29, for example, is released just to such a point that only the medium being pumped by the arrangement according to the invention flows out of the pressure channel 17 into the return line 28, by way of the solenoid valve 29, and from there back into the work space 6.

The solution according to the invention is also particularly characterized by its very short construction, in terms of its longitudinal expanse, which is able to optimally utilize even very small construction spaces.

Furthermore, the solution according to the invention can be "standardized" as a unit and therefore can be used even for different pump sizes.

In this connection, the solution according to the invention can also be integrated into different regulation circuits, in simple and cost-advantageous manner.

REFERENCE SYMBOL LISTING

1 drive shaft
2 adjustment apparatus
3 housing
4 bearing
5 drive element
6 work space
7 through-hole
8 spring chamber
9 spring stop
10 reset spring
11 ring space
12 work chamber
13 work piston
14 dead-end bore
15 pivot cylinder
16 bore end
17 pressure channel
18 pump piston
19 piston pass-through bore
20 through-passage bore
21 eccentric bushing
22 suction kidney
23 pressure kidney
24 transfer bore
25 cylinder ring
26 piston bore
27 valve seat
28 return line
29 solenoid valve
30 ring channel
31 gap filter
32 piston ring
33 conveying pump
34 conveying circuit
35 setting slide

The invention claimed is:

1. Apparatus for defined longitudinal displacement of an adjustment apparatus (2) that rotates along with and within a drive shaft (1), along the center axis of the work shaft, having a drive shaft (1) mounted in/on a housing (3), in a bearing (4), driven by a drive element (5), projecting into a work space (6) filled with pressurized medium, having a through-hole (7), wherein a spring chamber (8) is disposed in the region of the through-hole (7), and wherein a spring stop (9) is disposed on the adjustment apparatus (2), in such a manner that the adjustment apparatus (2) is always brought back into a defined starting position after every axial displacement, by means of a reset spring (10) that is disposed in the spring chamber (8), and wherein a work chamber (12) is disposed at the end of the drive shaft (1) that lies opposite the drive element (5), into which chamber the through-hole (7) opens, wherein a work piston (13) that enters into an active connection with the work chamber (12) is disposed on the adjustment apparatus (2), in such a manner that when pressure builds up in the work chamber (12), the adjustment apparatus (2) is variably displaced, counter to the spring force of the reset spring (10), and wherein a pump piston (18) having a piston pass-through bore (19), which bore opens into a pressure channel (17) disposed in the housing (3), is disposed in the housing (3), so as to pivot, and wherein the drive shaft (1) is configured as an eccentric shaft in the region of the pump piston (18), or wherein an eccentric bushing (21) is disposed in the region of the pump piston (18), on the drive shaft (1), so as to rotate with it, wherein a suction kidney (22) connected with the work space (6), on the one hand, and a pressure kidney (23) that lies opposite this suction kidney (22) on the circumference of the eccentric mechanism, on the other hand, are disposed in the cam, in each instance, wherein the pressure kidney (23) has a/multiple transfer bore(s) (24) disposed in the eccentric mechanism, which bore(s) connect(s) the pressure kidney (23) directly with the ring space (11), and wherein a cylinder ring (25) having a piston bore (26) for the pump piston (18) is disposed on the outer mantle of the eccentric bushing (21), so as to rotate, in such a manner that when the eccentric bushing (21) is rotating in the piston bore (26) of the cylinder ring (25), the pump piston (18) "works," i.e. moves vertically up and down in oscillating manner, and wherein a valve seat (27) is disposed in the housing (3), into which seat the pressure channel (17) opens, on the one hand, and a return line (28) connected with the work space (6) opens, on the other hand, and wherein a solenoid valve (29) is disposed in the valve seat (27), between the pressure channel (17) and the return line (28).

2. Method for defined longitudinal displacement of an adjustment apparatus (2) that rotates along with and within a drive shaft (1), by means of the apparatus according to claim 1, wherein the adjustment apparatus (2) is displaced in defined manner along the center axis of the work shaft (1), by means of varying the pressure in the pressure channel (17).

3. Apparatus for defined longitudinal displacement of an adjustment apparatus (2) that rotates along with and within a drive shaft (1), according to claim 1, wherein a pivot cylinder (15) provided with a dead-end bore (14) that is closed off toward the work space (6) is disposed in the housing (3) on the work space side, the open bore end (16) of which cylinder opens into the pressure channel (17), wherein a pump piston (18) having a piston pass-through bore (19) is disposed on the pivot cylinder (15), so as to rotate, and this piston pass-through bore (19) opens into the dead-end bore (14) of the pivot cylinder (15) by way of a through-passage bore (20) disposed in the pivot cylinder (15) in the region of the piston pass-through bore (19).

4. Apparatus for defined longitudinal displacement of an adjustment apparatus (2) that rotates along with and within a drive shaft (1), according to claim 1, wherein the transfer region into the suction kidney (22) is configured as a ring channel (30), adjacent to which, toward the work space (6), a ring-shaped gap filter (31) is disposed.

5. Apparatus for defined longitudinal displacement of an adjustment apparatus (2) that rotates along with and within a drive shaft (1), according to claim 1, wherein piston rings (32) are disposed on the outside circumference of the region of the pump piston (18) that is displaceably mounted in the piston bore (26) of the cylinder ring (25).

* * * * *